US011358837B2

(12) United States Patent
Rocher et al.

(10) Patent No.: US 11,358,837 B2
(45) Date of Patent: Jun. 14, 2022

(54) ELEVATOR CAR CEILING ACCESS SYSTEM

(71) Applicant: Otis Elevator Company, Farmington, CT (US)

(72) Inventors: Jean-Emile Rocher, Lorris (FR); Arnaud Blanchard, Adon (FR)

(73) Assignee: OTIS ELEVATOR COMPANY, Palm Beach Gardens, FL (US)

( * ) Notice: Subject to any disclaimer, the term of this patent is extended or adjusted under 35 U.S.C. 154(b) by 600 days.

(21) Appl. No.: 16/364,996

(22) Filed: Mar. 26, 2019

(65) Prior Publication Data

US 2019/0300338 A1 Oct. 3, 2019

(30) Foreign Application Priority Data

Mar. 27, 2018 (EP) ..... 18305339

(51) Int. Cl.

| | |
|---|---|
| ***B66B 11/02*** | (2006.01) |
| ***B66B 1/50*** | (2006.01) |
| ***B66B 13/06*** | (2006.01) |
| ***B66B 13/02*** | (2006.01) |

(52) U.S. Cl.

CPC ..... *B66B 11/0246* (2013.01); *B66B 1/50* (2013.01); *B66B 13/02* (2013.01); *B66B 13/06* (2013.01)

(58) Field of Classification Search

CPC ..... B66B 11/0246; B66B 1/50; B66B 13/02; B66B 13/06; B66B 11/0226

See application file for complete search history.

(56) References Cited

U.S. PATENT DOCUMENTS

| | | | | |
|---|---|---|---|---|
| 6,340,073 | B1 | 1/2002 | Lee et al. | |
| 7,237,655 | B2 | 7/2007 | Kocher et al. | |
| 7,638,962 | B2 | 12/2009 | Cardwell | |
| 8,369,057 | B2 | 2/2013 | Bourgeois et al. | |
| 8,925,980 | B2 | 1/2015 | Heikintupa et al. | |
| 2007/0056809 | A1 | 3/2007 | Fernandes et al. | |
| 2017/0297868 | A1* | 10/2017 | Aitamurto | E05B 17/22 |
| 2017/0320704 | A1 | 11/2017 | Studer et al. | |

FOREIGN PATENT DOCUMENTS

| | | | |
|---|---|---|---|
| CN | 103922213 | A | 7/2014 |
| CN | 203998544 | U | 12/2014 |
| CN | 205906850 | U | 1/2017 |

(Continued)

OTHER PUBLICATIONS

"Specialty Access Products", [Retrieved via internet: http://www.powercreation.com.hk/dl/Catalog_English.pdf] Feb. 14, 2018, Bilco Corporate (44 pages).

(Continued)

*Primary Examiner* — Jeffrey Donels
(74) *Attorney, Agent, or Firm* — Cantor Colburn LLP

(57) ABSTRACT

Elevator car ceiling access systems are provided. The elevator car ceiling access systems include an elevator car having a top and at least one elevator car door, an access panel located in a top of the elevator car, a car door operator, an access panel operator, and a selectively engageable coupling arranged between the car door operator and the access panel operator and arranged to selectively couple to the car door operator and the access panel operator to enable selective opening of the access panel.

20 Claims, 8 Drawing Sheets

(56) References Cited

FOREIGN PATENT DOCUMENTS

| | | | |
|---|---|---|---|
| CN | 106698159 | A | 5/2017 |
| EP | 1566357 | A1 | 8/2005 |
| JP | S56145090 | A | 11/1981 |
| JP | H0416483 | A | 1/1992 |
| JP | 4149341 | B2 | 9/2008 |
| WO | 2004020322 | A1 | 3/2004 |
| WO | 2006087923 | A1 | 8/2006 |
| WO | 2007091292 | A1 | 8/2007 |
| WO | 2008090593 | A1 | 7/2008 |
| WO | 2014027392 | A1 | 2/2014 |
| WO | 2016162710 | A1 | 10/2016 |

OTHER PUBLICATIONS

European Search Report for European Application No. 18305339, International Filing Date Mar. 27, 2018, dated Sep. 10, 2018, 8 pages.

* cited by examiner

ELEVATOR CAR CEILING ACCESS SYSTEM

CROSS REFERENCE TO RELATED APPLICATIONS

This application claims the benefit of European Application No. 18305339.6, filed Mar. 27, 2018, which is incorporated herein by reference in its entirety.

BACKGROUND

The subject matter disclosed herein generally relates to elevator systems and, more particularly, to elevator access systems and in particular to elevator car ceiling access systems.

Elevator systems require maintenance to be performed on the various components thereof, with some such components located exterior to an elevator car, such as within an elevator shaft. To perform maintenance on such components, technicians may be required to gain access to the exterior of the elevator car. Accordingly, typical elevator cars are provided with a ceiling access panel or similar opening to allow for a technician to access the top of an elevator car from the inside of the elevator car. The ceiling access panels are manually operable and can be difficult to access depending on the size or dimensions of the elevator car. Accordingly, improved access to and operation of ceiling access panels of elevator cars may be advantageous.

SUMMARY

According to some embodiments, elevator car ceiling access systems are provided. The elevator car ceiling access systems include an elevator car having a top and at least one elevator car door, an access panel located in a top of the elevator car, a car door operator, an access panel operator, and a selectively engageable coupling arranged between the car door operator and the access panel operator and arranged to selectively couple to the car door operator and the access panel operator to enable selective opening of the access panel.

In addition to one or more of the features described above, or as an alternative, further embodiments of the elevator car ceiling access systems may include that the access panel operator includes a first pulley, a second pulley, and an access panel cable operably connecting the first pulley to the access panel.

In addition to one or more of the features described above, or as an alternative, further embodiments of the elevator car ceiling access systems may include a lock arranged to selectively secure the access panel in a closed position.

In addition to one or more of the features described above, or as an alternative, further embodiments of the elevator car ceiling access systems may include that the lock includes an electrically driven lock driver and a lock pin, wherein, in a closed state, the lock pin engages with a locking bracket of the access panel.

In addition to one or more of the features described above, or as an alternative, further embodiments of the elevator car ceiling access systems may include that the selectively engageable coupling is electrically connected to a control panel to enable selective operation of the selectively engageable coupling.

In addition to one or more of the features described above, or as an alternative, further embodiments of the elevator car ceiling access systems may include that the control panel is a car operating panel of the elevator car.

In addition to one or more of the features described above, or as an alternative, further embodiments of the elevator car ceiling access systems may include that the car door operator includes a pulley and a door operator cable operably connected to the pulley of the car door operator.

In addition to one or more of the features described above, or as an alternative, further embodiments of the elevator car ceiling access systems may include that the selectively engageable coupling includes a motor and drive shaft arranged to selectively drive operation of car door operator and the access panel operator.

In addition to one or more of the features described above, or as an alternative, further embodiments of the elevator car ceiling access systems may include that a pulley of the access panel operator is attached to the drive shaft.

In addition to one or more of the features described above, or as an alternative, further embodiments of the elevator car ceiling access systems may include a first coupling element arranged to selectively couple with the car door operator and a second coupling element arranged to selectively couple with the access panel operator.

In addition to one or more of the features described above, or as an alternative, further embodiments of the elevator car ceiling access systems may include that at least one of the first coupling element and the second coupling element comprises an armature and a friction ring.

In addition to one or more of the features described above, or as an alternative, further embodiments of the elevator car ceiling access systems may include that the selectively engageable coupling includes a first electromagnet arranged proximate to the car door operator and a second electromagnet arrange proximate the access panel operator, wherein the first and second electromagnets are arranged to selectively control engagement with the car door operator and the access panel operator.

In addition to one or more of the features described above, or as an alternative, further embodiments of the elevator car ceiling access systems may include that the access panel is hingedly connected to the top of the elevator car.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
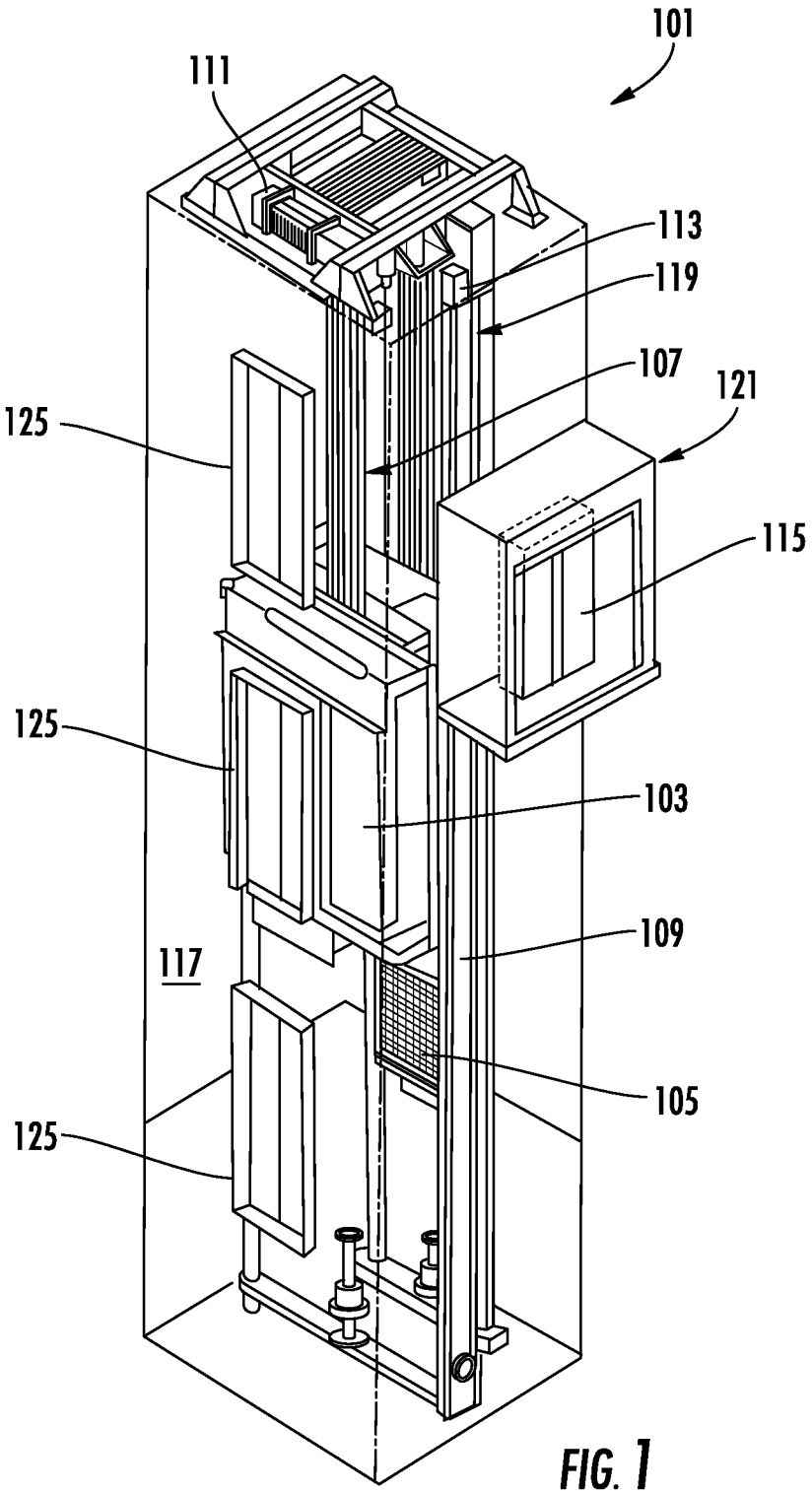
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which, in this illustrative embodiment, is part of an overhead structure of the elevator system 101, although other arrangements are possible without departing from the scope of the present disclosure. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown in the illustrative arrangement, in a controller room 121 of the elevator shaft 117 and is configured to control the operation of the elevator system 101, and particularly the elevator car 103. In other embodiments the controller 115 can be located in other locations, including, but not limited to, fixed to a landing or landing door or located in a cabinet at a landing. The elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
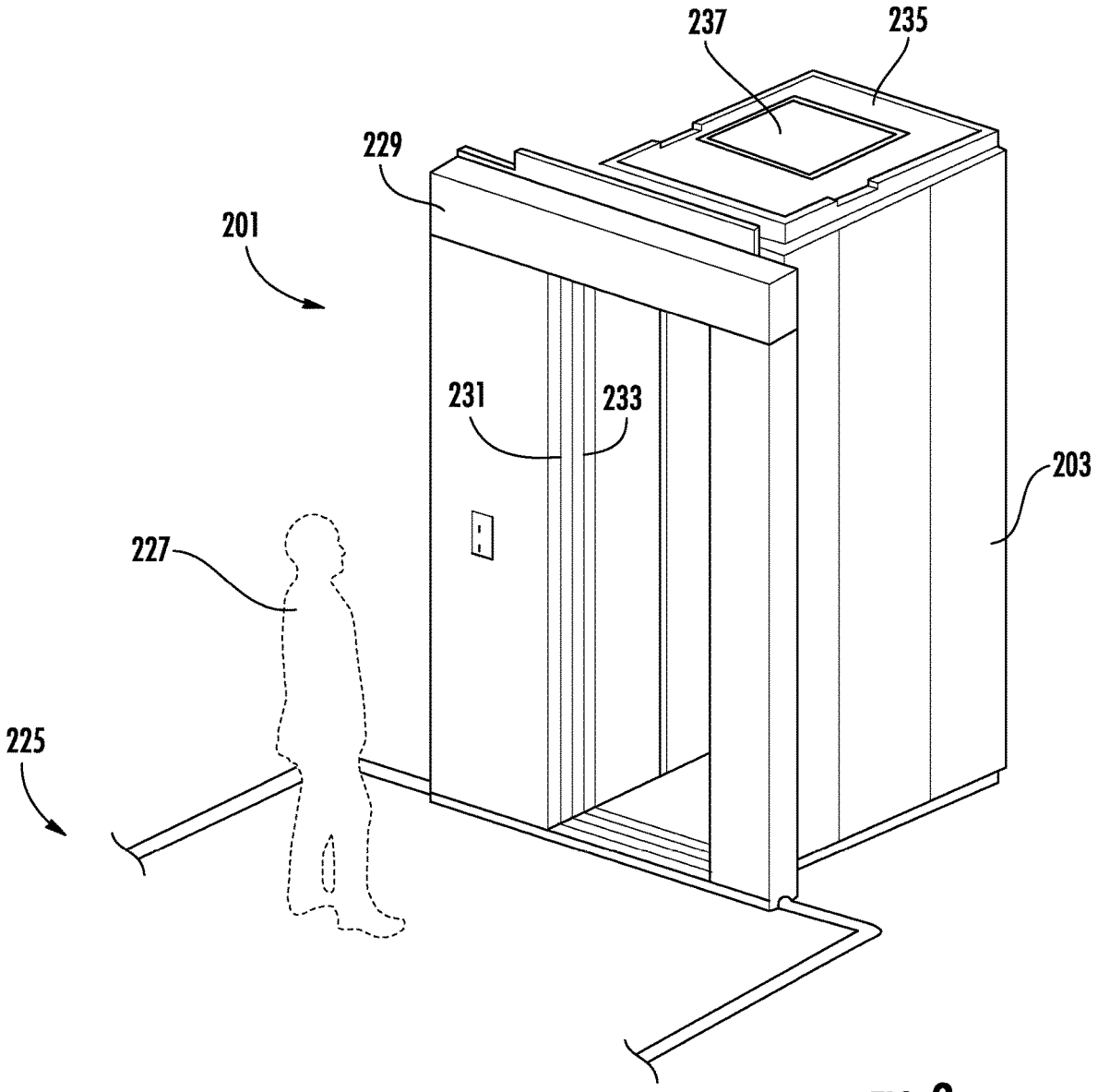
FIG. 2 is a schematic illustration of a landing door of an elevator system that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on a portion of the elevator system 201. A car door lintel 229 of the elevator system 201 can include a door opening system or door operator to enable opening and closing of car doors 231 and landing doors 233 when the elevator car 203 is located at the landing 225. At times, such as during maintenance operations, a mechanic 227 may need to access an elevator car top 235 through a ceiling access panel 237. Embodiments provided herein are directed to improved systems for opening and operating ceiling access panels and providing access to an elevator car top.

Figure 3:
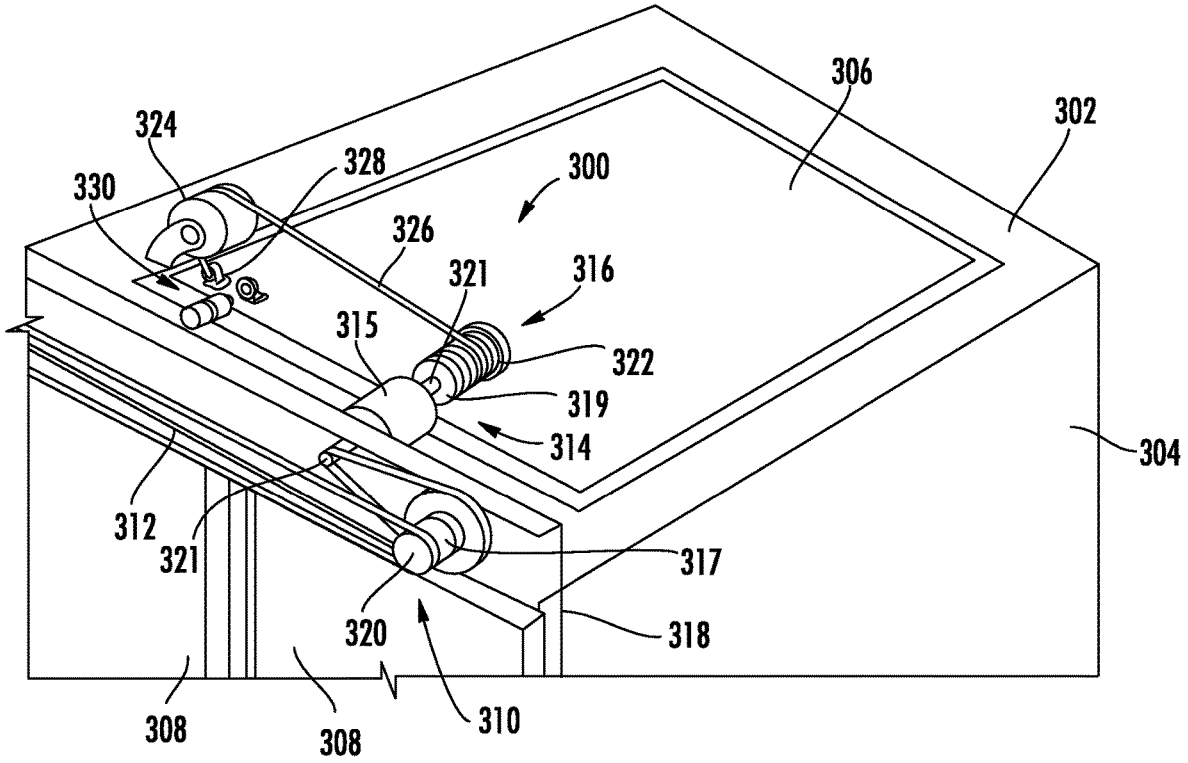
FIG. 3 is a schematic illustration of an elevator car ceiling access system in accordance with an embodiment of the present disclosure.

Turning now to FIG. 3, a schematic illustration of an elevator car ceiling access system 300 is shown. The elevator car ceiling access system 300 is mounted or installed on atop 302 of an elevator car 304. The top 302 of the elevator car 304 includes an access panel 306 that is openable to allow access to an exterior of the elevator car 304. The elevator car 304 further includes elevator car doors 308 that are openable by a car door operator 310 which includes a door operator cable 312 (e.g., door aircord, belt, etc.), as will be appreciated by those of skill in the art.

The elevator car ceiling access system 300 is coupled to or includes the car door operator 310 to enable opening and/or closing of the ceiling access panel 306. The elevator car ceiling access system 300 is mounted to the top 302 of the elevator car 304 and/or a sill 318 and provides a selectively engageable coupling 314 that couples to the car door operator 310 and to an access panel operator 316. That is, the selectively engageable coupling 314 of the elevator car ceiling access system 300 includes the car door operator 310, the access panel operator 316, and a motor 315 operably connected between both the car door operator 310 and the access panel operator 316. The selectively engageable coupling 314 is operable to selectively couple and drive, using motor 315, one or the other of the car door operator 310 and the access panel operator 316. As shown, the car door operator 310 is at least partially mounted to the sill 318 with a car door pulley 320 operably coupled to the door operator cable 312.

The access panel operator 316 includes a first pulley 322 and a second pulley 324 with an access panel cable 326 extending around the pulleys 322, 324 and fixedly connected to the access panel 306. The access panel cable 326 connects to the access panel 306 by a fixed coupling 328. The first pulley 322, in some embodiments, is a drivable pulley that can be driven or rotated by the motor 315 and the second pulley 324 is an idle pulley that allows the access panel cable 326 to travel about the second pulley 324 during operation (opening/closing) of the access panel 306.

In normal operation, the car door operator 310 is engaged and operates as known in the art to enable opening and closing of the elevator car doors 308. Engagement of the car door operator 310 is provided through a first coupling element 317, as described below. The first coupling element 317 can be selectively controlled or operated to engage with the car door pulley 320 to enable the motor 315 to drive operation of the elevator car doors 308. However, in a maintenance mode of operation, the first coupling element 317 may disengage from connection with the car door pulley 320 of the car door operator 310 and a second coupling element 319 will engage with the access panel operator 316 and the first pulley 322 thereof, thus allowing opening and closing of the access panel 306.

The motor 315 of the selectively engageable coupling 314, in some embodiments, includes a drive shaft 321 that is used for driving operation of the car door operator 310, as will be appreciated by those of skill in the art. Further, when switched from engagement with the car door operator 310 to engagement with the access panel operator 316, the motor 315 is used to drive opening and/or closing of the access panel 306. The motor 315 drives rotation of the drive shaft which can rotate the car door pulley 320 of the car door operator 310 or the first pulley 322 of the access panel operator 316, depending on which operator 310, 316 the selectively engageable coupling 314 is operably coupled or connected to, e.g., by engagement of the first or second coupling elements 317, 319. The motor 315 may be fixedly mounted to or attached to the sill 318 and/or the top 302 of the elevator car 304. The first pulley 322 of the access panel operator 316 may be mounted to and/or part of the drive shaft 321 and thus is mounted to the top 302 or sill 318 through the motor 315.

The elevator car ceiling access system 300 further includes a lock 330. The lock 330 can secure the access panel 306 to the top 302 of the elevator car 304 when not in operation, thus preventing unauthorized access to the exterior of the elevator car 304. In some embodiments, the lock 330 may be an electromechanical lock that is connected to an electrical circuit of the elevator car 304. For example, in some embodiments, the lock 330 of the elevator car ceiling access system 300 can be electrically connected to a car operating panel or other control panel of the elevator car 304 or other part of the elevator system. In such embodiments, a mechanic can use the car operating panel to operate the lock 330 to unlock the access panel 306 to allow opening thereof and thus gain access to the top 302 of the elevator car 304.

In some embodiments, the first pulley 322 can be driven by the selectively engageable coupling 314 to unspool the access panel cable 326 to lower or open the access panel 306. In other embodiments, the access panel 306 may open merely by the pull of gravity, with the access panel cable 326 providing a maximum opening and/or to aid in smooth opening of the access panel 306. When closing, the selectively engageable coupling 314 can drive the first pulley 322 of the access panel operator 316 to re-spool the access panel cable 326 and pull the access panel 306 into a closed position. When in the closed position, the lock 330 can be reengaged to secure the access panel 306 to the top 302 of the elevator car 304.

Figure 4:
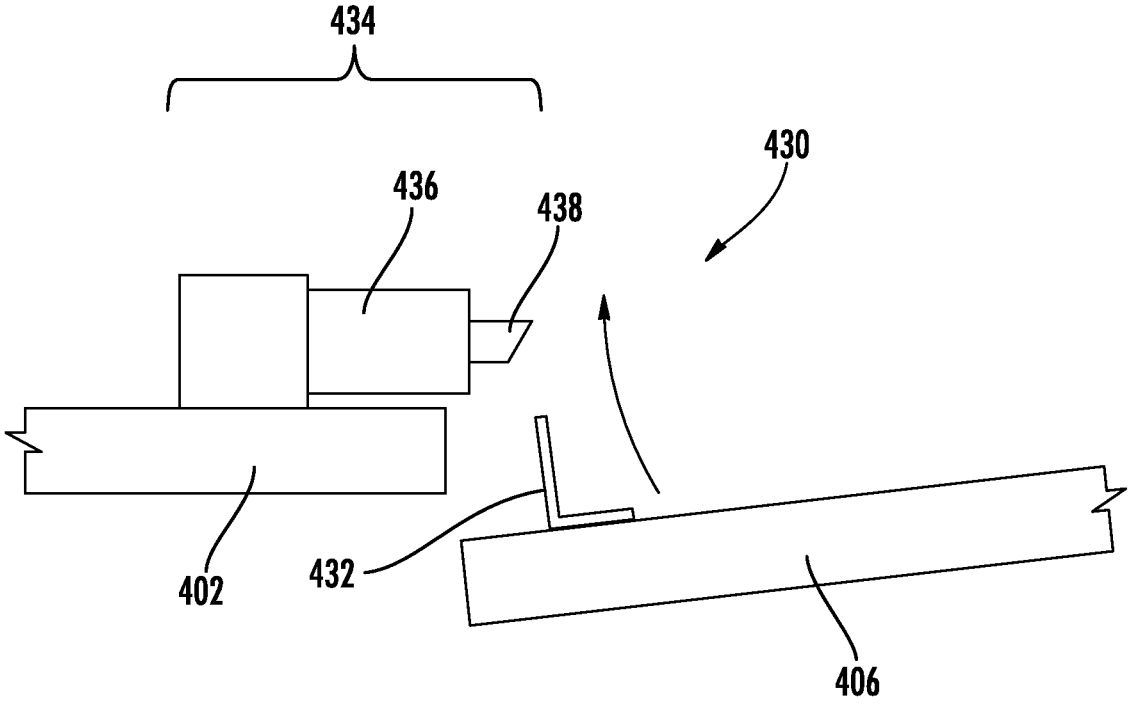
FIG. 4 is a schematic illustration of a lock of an elevator car ceiling access system in accordance with an embodiment of the present disclosure.

Turning now to FIG. 4, a schematic illustration of a lock 430 in accordance with a non-limiting embodiment of the present disclosure is shown. The lock 430 includes a locking bracket 432 that is fixedly attached to an access panel 406. A locking mechanism 434 is mounted to a top 402 of an elevator car, with the locking mechanism 434 including a lock driver 436 and a lock pin 438. In a closed state (not shown) the lock pin 438 engages with the locking bracket 432 to secure the access panel 406 into or relative to the top 402 of the elevator car, thus preventing access to the top 402 of the elevator car. To open the access panel 406, a mechanic can operate a control circuit or control panel (e.g., at a car operating panel) to actuate the lock driver 436 to retract the lock pin 438 (e.g., electromagnetic operation) and thus release the connection with the access panel 406. As such, the lock may include an electrically driven lock driver 436 to drive movement, actuation, or operation of the lock pin 438. When unlocked, the access panel 406 may be lowered by operation of a pulley system or by gravity. To relock the access panel 406, the pulley system may pull the access panel 406 back up into position such that the locking bracket 432 aligns with the lock driver 436 and the lock pin 438, and the lock pin 438 can be actuated to reengage with the locking bracket 432. In some embodiment, the movement of the access panel 406 may be manual. Further, in some embodiments, the lock pin 438 may be biased into the locking position and as the locking bracket 432 is moved into position, it will urge the lock pin 438 into the lock driver 436 and once aligned, the lock pin 438 may be urged back into engagement with the locking bracket 432.

Figure 5A:
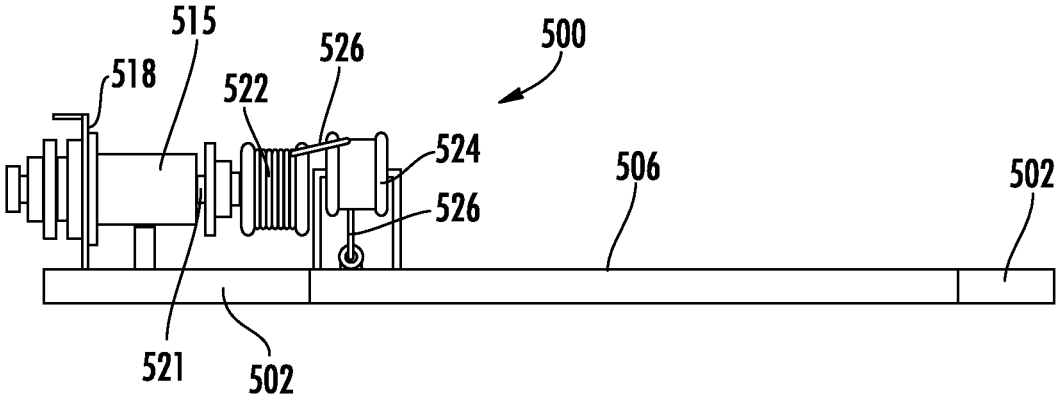
FIG. 5A is a schematic illustration of an elevator car ceiling access system in accordance with an embodiment of the present disclosure in a closed state.
Figure 5B:
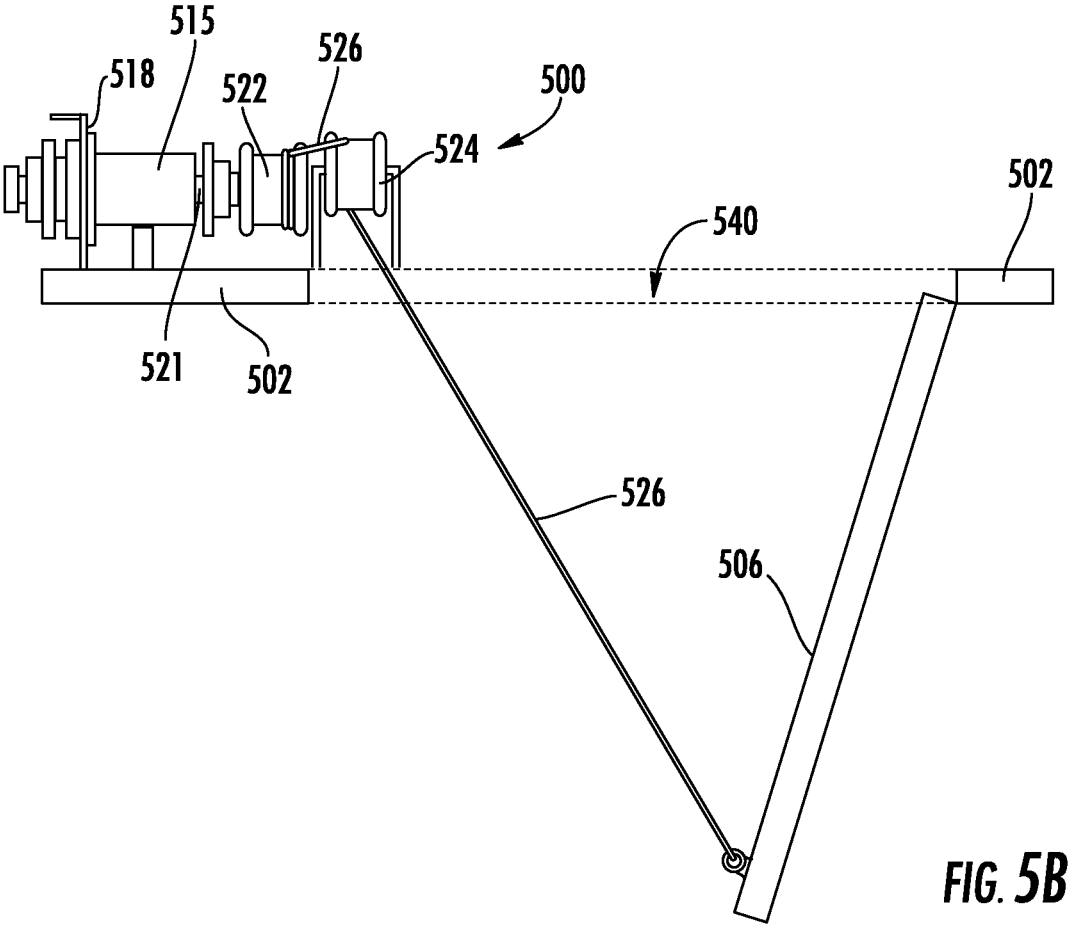
FIG. 5B is a schematic illustration of an elevator car ceiling access system in accordance with an embodiment of the present disclosure in an open state.

Turning now to FIGS. 5A-5B, schematic illustrations of an elevator car ceiling access system 500 in accordance with an embodiment of the present disclosure are shown. FIG. 5A illustrates the elevator car ceiling access system 500 in a closed and locked state and FIG. 5B illustrates the elevator car ceiling access system 500 in an open state. The elevator car ceiling access system 500 may be similar to the configurations shown and described above. In the closed state, an access panel 506 is secured and locked in position relative to a top 502 of an elevator car, as shown in FIG. 5A. As shown in FIG. 5B, the access panel 506 is opened and supported, in part, by an access panel cable 526. When opened, as shown in FIG. 5B, an access opening 540 is provided such that a mechanic or other authorized personnel can access an exterior of the elevator car.

As shown in FIGS. 5A-5B, a motor 515 of the elevator car ceiling access system 500 can be mounted to a sill 518 and/or to the top 502. A brace, bracket, or other support can be used to mount the motor 515 to the top 502 of an elevator car, as illustratively shown. Further, as shown, a first pulley 522 can be supported or connected to the motor 515 by a drive shaft 521 that is driven by the motor 515. A second pulley 524 of the elevator car ceiling access system 500 may also be mounted to the top 502 of the elevator car, by a bracket, support, or other structure. The access panel cable 526 is wound about the first pulley 522 and extends around or about the second pulley 524 to connect with the access panel 506.

Figure 6:
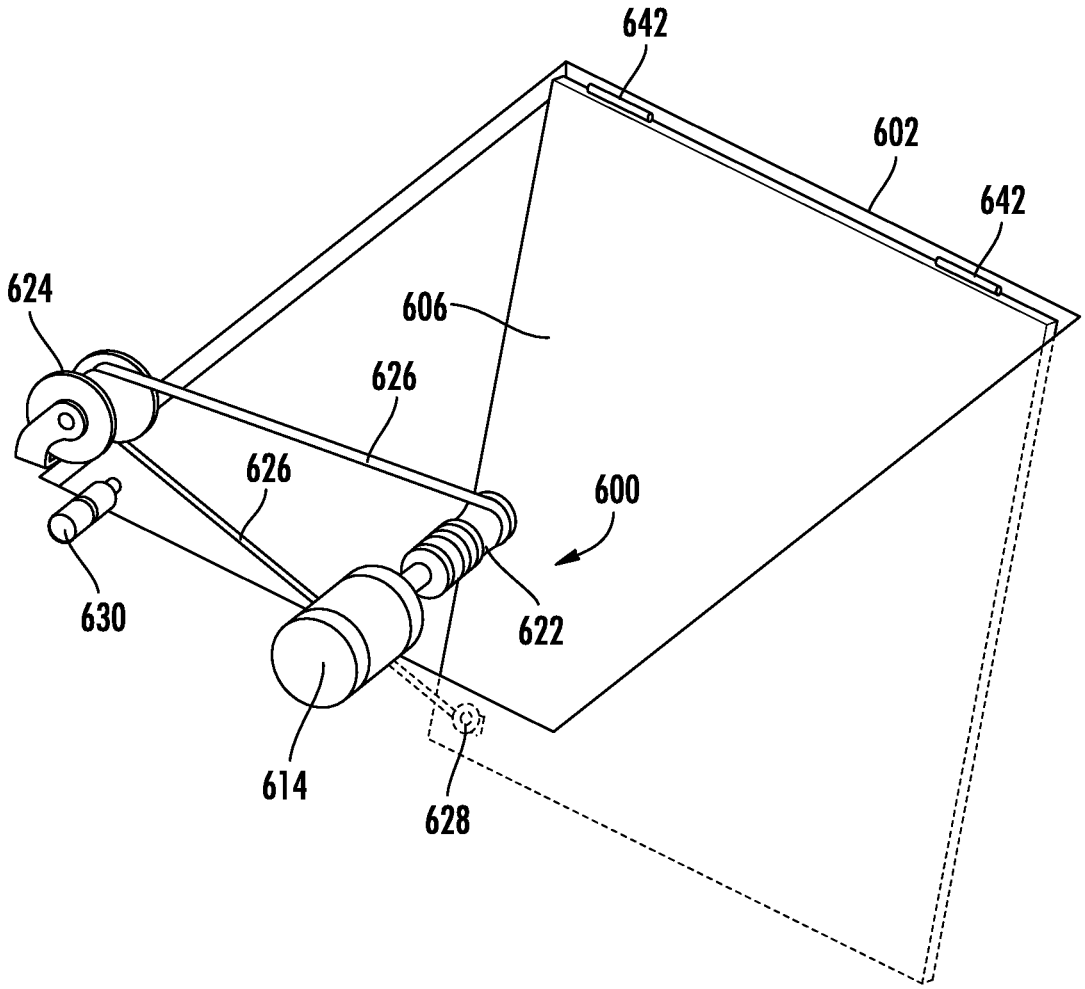
FIG. 6 is a schematic illustration of an elevator car ceiling access system in accordance with an embodiment of the present disclosure.

Turning now to FIG. 6, a schematic illustration of an elevator car ceiling access system 600 in accordance with an embodiment of the present disclosure is shown. In FIG. 6, an access panel 606 is shown in an open position and suspended or retained by an access panel cable 626 that is connected at one end to the access panel 606 at a fixed coupling 628 and at the other end to a first pulley 622 and disposed about a second pulley 624. As shown, the first pulley 622 is operably connected to a selectively engageable coupling 614, as described herein. The access panel 606 is hingedly connected to a top 602 of an elevator car by hinges 642. The access panel 606 can be secured into a closed position by a lock 630, similar to that described above.

Figure 7:
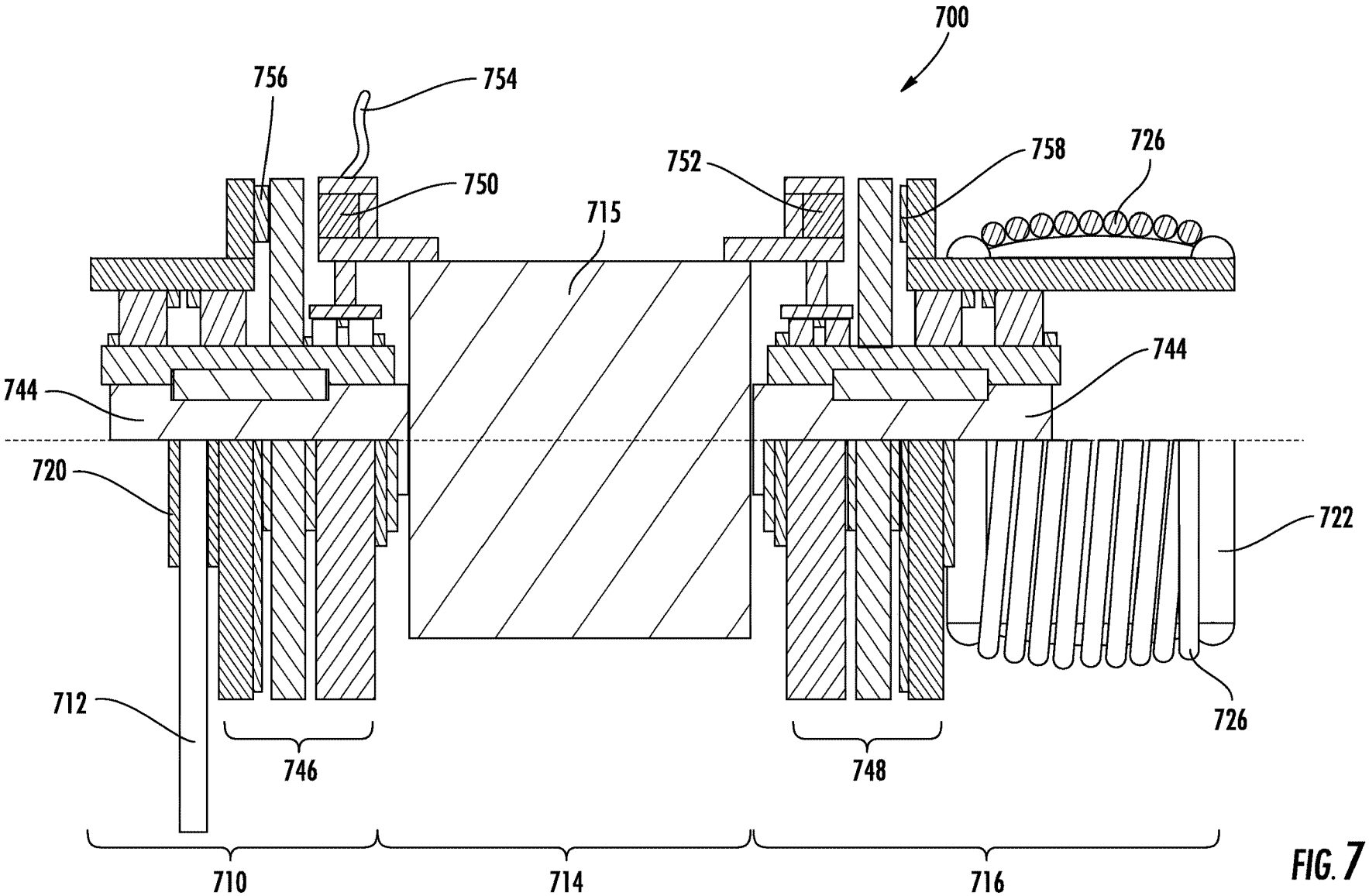
FIG. 7 is a schematic illustration of a coupling arrangement of an elevator car ceiling access system in accordance with an embodiment of the present disclosure.

Turning now to FIG. 7, a schematic illustration of an operation of an elevator car ceiling access system 700 in accordance with an embodiment of the present disclosure is shown. The elevator car ceiling access system 700 includes a selectively engageable coupling 714 operably connecting a car door operator 710 and an access panel operator 716. The car door operator 710 includes a car door pulley 720 with at least a portion of a door operator cable 712 connected thereto. The car door pulley 720 of the car door operator 710 is rotatable to operate (e.g., open/close) an elevator system door. The access panel operator 716 includes a first pulley 722 with an access panel cable 726 wrapped thereon. The first pulley 722 of the access panel operator 716 is rotatable to spool and unspool the access panel cable 726 during operation (e.g., opening/closing) of an access panel.

The selectively engageable coupling 714 includes a motor 715 or other drive mechanism to drive rotation of a drive shaft 744 (e.g., an axle). Fixedly connected to the drive shaft 744 is a first coupling element 746 and a second coupling element 748. The first coupling element 746 is arranged to selectively couple with a portion of the car door pulley 720 of the car door operator 710 and the second coupling element 748 is arranged to selectively couple with a portion of the first pulley 722 of the access panel operator 716.

Selective coupling is controlled by operation of a first electromagnet 750 and a second electromagnet 752. The first electromagnet 750 is arranged proximate to the car door pulley 720 of the car door operator 710 and the second electromagnet 752 is arranged proximate to the first pulley 722 of the access panel operator 716. By applying current through a control circuit 754 (e.g., by operation at a car operating panel) one or the other of the first and second electromagnets 750, 752 may be energized to act or pull upon a respective pulley 720, 722. For example, the car door pulley 720 of the car door operator 710 can include a first magnet 756 and the first pulley 722 of the access panel operator 716 can include a second magnet 758. When the first electromagnet 750 is energized, the car door pulley 720 of the car door operator 710 will be urged to the right in FIG. 7 such that the first magnet 756 will contact and magnetically engage with the first coupling element 746. When the drive shaft 744 is driven by the selectively engageable coupling 714, the drive shaft 744 will rotate, and thus the first coupling element 746 and engaged car door pulley 720 of the car door operator 710 will rotate. This is the arrangement schematically shown in FIG. 7. As shown, the second magnet 758 is not engaged with the second coupling element 748, and thus the first pulley 722 of the access panel operator 716 does not rotate. Although described herein as a magnet, those of skill in the art will appreciate that any ferromagnetic material may be employed without departing from the scope of the present disclosure.

However, when it is desired to open an access panel of the present disclosure, a mechanic or other authorized personnel can use a control operation (e.g., at a car operating panel) to energize the second electromagnet 752 (and de-energize the first electromagnet 750). When the second electromagnet 752 is energized, the second magnet 758 that is coupled to or part of the first pulley 722 of the access panel operator 716 will be urged to the left in FIG. 7 such that the second magnet 758 will contact and engage with the second coupling element 748. At the same time, the car door pulley 720 of the car door operator 710 will move to the left and disengage from the first coupling element 746. Accordingly, the selectively engageable coupling 714 can be used to drive operation of the access panel operator 716 (e.g., open a ceiling panel of an elevator car).

Figure 8:
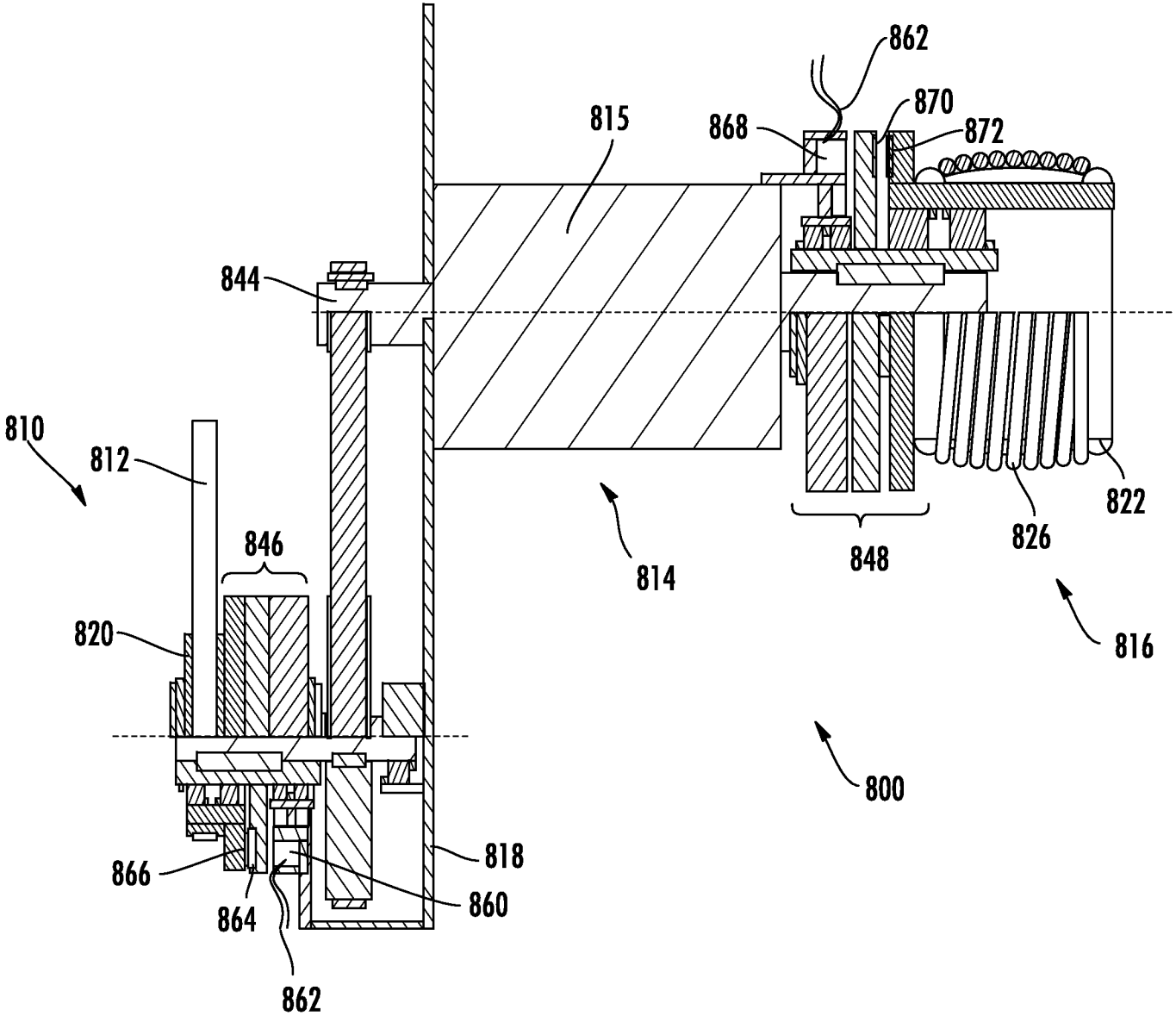
FIG. 8 is a schematic illustration of a coupling arrangement of an elevator car ceiling access system in accordance with an embodiment of the present disclosure.

Turning now to FIG. 8, a schematic illustration of an alternative arrangement of an elevator car ceiling access system 800 in accordance with an embodiment of the present disclosure is shown. The elevator car ceiling access system 800 includes a selectively engageable coupling 814 having a motor 815 that is operably connected to a car door operator 810 and an access panel operator 816. The car door operator 810 includes a car door pulley 820 with at least a portion of a door operator cable 812 connected thereto. The car door pulley 820 of the car door operator 810 is rotatable to operate (e.g., open/close) an elevator system door. The access panel operator 816 includes a first pulley 822 with an access panel cable 826 wrapped thereon. The first pulley 822 of the access panel operator 816 is rotatable to spool and unspool the access panel cable 826 during operation (e.g., opening/closing) of an access panel.

The selectively engageable coupling 814 includes the motor 815 or other drive mechanism to drive rotation of a drive shaft 844 (e.g., an axle). Connected to the drive shaft 844 is a first coupling element 846 and a second coupling element 848. The first coupling element 846 is arranged to selectively couple with a portion of the car door pulley 820 of the car door operator 810 and the second coupling element 848 is arranged to selectively couple with a portion of the first pulley 822 of the access panel operator 816.

Selective coupling is controlled by operation of an electromagnet 860 (e.g., a permanent magnet and a coil) that is part of the car door operator 810. The electromagnet 860 is arranged proximate to the car door pulley 820 of the car door operator 810. During normal operation, the magnet of the electromagnet 860 will for engagement of a first friction ring 864 and a first armature 866 to force a coupling between the motor 815 and the car door pulley 820 and thus no current is needed for normal operation of the elevator car doors.

By applying current through the control circuit 862 the permanent magnet of the electromagnet 860 can be neutralized and thus allow movement of the system for engagement with the access panel operator 816. For example, an access panel coil 868 can be energized to force a second friction ring 870 into engagement with a second armature 872 of the first pulley 822. When the access panel coil 868 and the coil of the electromagnet 860 are energized, the first armature 866 will be urged out of engagement with the first friction ring 864 such that the car door pulley 820 will be disengaged. At the same time, the energized access panel coil 868 will urge the second friction ring 870 into engagement with the second armature 872 to allow operation and rotation of the first pulley 822. When the drive shaft 844 is driven by the motor 815, the drive shaft 844 will rotate, and thus the second coupling element 846 and engaged first pulley 822 of the access panel operator 816 will rotate.

Advantageously, embodiments described herein provide for an easy to use and secure access panel in a top of an elevator car. Such systems allow for opening of ceiling panels or other access panels of elevator cars to be opened, regardless of height or dimensions of the elevator car. Further, advantageously, embodiments provided herein do not require additional mechanisms as the system is operably coupled to existing car door operators.

As used herein, the use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car ceiling access system comprising:

an elevator car having a top and at least one elevator car door;

an access panel located in a top of the elevator car;

a car door operator;

an access panel operator; and a selectively engageable coupling arranged between the car door operator and the access panel operator and arranged to selectively couple to the car door operator and the access panel operator to enable selective opening of the access panel.

2. The elevator car ceiling access system of claim 1, wherein the car door operator includes a pulley and a door operator cable operably connected to the pulley of the car door operator.

3. The elevator car ceiling access system of claim 1, wherein the selectively engageable coupling includes a first electromagnet arranged proximate to the car door operator and a second electromagnet arrange proximate the access panel operator, wherein the first and second electromagnets are arranged to selectively control engagement with the car door operator and the access panel operator.

4. The elevator car ceiling access system of claim 1, wherein the access panel is hingedly connected to the top of the elevator car.

5. The elevator car ceiling access system of claim 1, further comprising a lock arranged to selectively secure the access panel in a closed position.

6. The elevator car ceiling access system of claim 5, wherein the lock includes an electrically driven lock driver and a lock pin, wherein, in a closed state, the lock pin engages with a locking bracket of the access panel.

7. The elevator car ceiling access system of claim 1, wherein the selectively engageable coupling is electrically connected to a control panel to enable selective operation of the selectively engageable coupling.

8. The elevator car ceiling access system of claim 7, wherein the control panel is a car operating panel of the elevator car.

9. An elevator car ceiling access system comprising:

an elevator car having a top and at least one elevator car door;

an access panel located in a top of the elevator car;

a car door operator;

an access panel operator; and a selectively engageable coupling arranged between the car door operator and the access panel operator and arranged to selectively couple to the car door operator and the access panel operator to enable selective opening of the access panel, wherein the access panel operator includes a first pulley, a second pulley, and an access panel cable operably connecting the first pulley to the access panel.

10. The elevator car ceiling access system of claim 9, further comprising a lock arranged to selectively secure the access panel in a closed position.

11. The elevator car ceiling access system of claim 10, wherein the lock includes an electrically driven lock driver and a lock pin, wherein, in a closed state, the lock pin engages with a locking bracket of the access panel.

12. The elevator car ceiling access system of claim 9, wherein the selectively engageable coupling is electrically connected to a control panel to enable selective operation of the selectively engageable coupling.

13. The elevator car ceiling access system of claim 12, wherein the control panel is a car operating panel of the elevator car.

14. The elevator car ceiling access system of claim 9, wherein the access panel is hingedly connected to the top of the elevator car.

15. The elevator car ceiling access system of claim 14, wherein a pulley of the access panel operator is attached to the drive shaft.

16. The elevator car ceiling access system of claim 15, further comprising a first coupling element arranged to selectively couple with the car door operator and a second coupling element arranged to selectively couple with the access panel operator.

17. The elevator car ceiling access system of claim 14, further comprising a first coupling element arranged to selectively couple with the car door operator and a second coupling element arranged to selectively couple with the access panel operator.

18. The elevator car ceiling access system of claim 17, wherein at least one of the first coupling element and the second coupling element comprises an armature and a friction ring.

19. An elevator car ceiling access system comprising:

an elevator car having a top and at least one elevator car door;

an access panel located in a top of the elevator car;

a car door operator;

an access panel operator; and a selectively engageable coupling arranged between the car door operator and the access panel operator and arranged to selectively couple to the car door operator and the access panel operator to enable selective opening of the access panel, wherein the selectively engageable coupling includes a motor and drive shaft arranged to selectively drive operation of car door operator and access panel operator.

20. The elevator car ceiling access system of claim 19, wherein the access panel is hingedly connected to the top of the elevator car.

* * * * *